United States Patent [19]

Taltre

[11] Patent Number: 4,927,139

[45] Date of Patent: May 22, 1990

[54] THERAPEUTIC BACK REST

[76] Inventor: Abraham K. Taltre, 1011 E. Ginter Rd., Tucson, Ariz. 85706

[21] Appl. No.: 360,859

[22] Filed: Jun. 2, 1989

[51] Int. Cl.[5] ..... A63B 23/00

[52] U.S. Cl. ..... 272/144; 5/431

[58] Field of Search ..... 128/69, 70, 68, 75; 272/144, 113, 145; 5/431, 432, 440, 461, 437; 297/220, 391

[56] References Cited

U.S. PATENT DOCUMENTS

| | | | |
|---|---|---|---|
| 1,170,119 | 2/1916 | Sefton | 5/461 X |
| 2,010,766 | 8/1935 | Longfellow | 128/69 X |
| 2,738,975 | 3/1956 | Zaboy | 272/145 |
| 3,006,643 | 4/1959 | Ryan . | |
| 3,343,531 | 9/1967 | Thompson | 128/69 |
| 3,378,259 | 11/1964 | Kupchinski . | |
| 3,544,125 | 12/1970 | Unno | 272/113 X |
| 3,747,916 | 7/1973 | Benson | 5/435 X |
| 4,210,322 | 7/1980 | Pritchard . | |
| 4,307,880 | 12/1981 | Abram | 272/144 |
| 4,451,034 | 5/1984 | Gin | 272/144 X |

*Primary Examiner*—Richard J. Apley
*Assistant Examiner*—H. Flaxman
*Attorney, Agent, or Firm*—J. Michael McClanahan

[57] ABSTRACT

A therapeutic back rest is described consisting of two semi-circular or half round steel supports, standing upright and spaced apart, with their ends resting upon the ground level. Connecting the two round supports at opposite ends are cross bars near the ground, one cross bar providing a foot support for mounting the back rest and the opposite cross bar providing one portion of a rectangular shaped opening adapted to receive a person's head. Covering the upper portion of the arc forming the arch is a plurality of flat wood slats bolted between each of the half round steel supports. Near the top of the arched back rest is a pair of nearly vertical pull up supports for the person's ease in using the device. A mat covers the wood slats, the mat having a rectangular head opening conforming to the opening in the structure. The therapeutic back rest provides a constant curving arch for the person's back, neck and pelvis area, completely lifting the person off the floor.

10 Claims, 1 Drawing Sheet

THERAPEUTIC BACK REST

BACKGROUND OF THE INVENTION

1. Field of the Invention

The field of the invention is therapeutic back rests whereby a patient's back and full body is allowed to conform to a specified shape which renders therapeutic and relaxation benefits.

2. Description of the Related Art

In the background of the invention, various types of back rests and/or back exercising machines have been devised in order to provide mechanisms which bend the body or support a person's back. For example, Ryan in U.S. Pat. No. 3,006,643 devised a body exercising bench which consists of a centrally located standard with pivoting slant boards on either side of the standard whereby a person may lie on the device with their waist at the standard and their feet conformed to one of the slant boards and their chest to the other. Such a device as shown by Ryan allows for controlled bending at the waist only. The example given in the drawings of the patent to Ryan suggests that the device is used by a party lying face front down since the angles of the slant boards illustrated seem to suggest only use in that position inasmuch as utilizing the device with the slant boards other than substantially horizontal for face up positions would be practically prohibitive. In any event, if the device of Ryan were utilized with a person lying face upward on the device with the slant boards themselves flat, the person's back would, in conforming to that, would also lie flat.

Similarly, Kupchinski in the U.S. Pat. No. 3,378,259 illustrated a similar exercising cot where again the body is bent at the middle wherein two flat slant boards, or material covered cots, are pivotally attached at a central place. Thus again, a person's back is not arched in following the provided support.

Lastly, Pritchard, in U.S. Pat. No. 4,210,322, discloses a portable tumbling mat where a person is allowed to lie in a supine position on the mat and a rounded convex portion rises up to support the person's back while their back is arched over it. Such support for a person's back does permit the back to arch by its own weight, however, it does not support the back over its full region, nor does it define necessarily the angle which the back is arched. In addition, the back is not permitted to arch with no other forces on the back inasmuch as the device is so constructed that the person's feet reside on the ground and thereby have an influence on the arching of the back by taking a portion of the back's weight off of the rounded convex portion of the mat.

It is apparent that it would be useful to provide a mechanism which provides therapeutic value to a person's back by removing all extraneous forces which a person might add to their back by allowing the back to completely comform to a fixed shape unaffected by any forces other than the person's own weight.

It would also be an apparent advantage if the person's body in the areas connective to the back, namely the pelvis and the neck, are also allowed to continue in the form designed for the back inasmuch as there would not be an abrupt change of angle of the neck and the back or the pelvis and the back at their point of joinder.

SUMMARY OF THE INVENTION

This invention relates to a novel therapeutic back rest providing total body support for an individual, i.e., completely supporting the individual's whole body off the ground, and providing a constant arch throughout the total person's back and connecting neck and pelvis. More particularly, the subject therapeutic back rest is defined by two half round or semi-circular steel or other metal supports standing upright, spaced equally apart with each of their ends resting on the ground, and with a plurality of flat wood or metal slats connecting between each of the steel supports defining an arched surface having a given radius for the person's body to conform to.

Upon this plurality of spaced apart flat wood slats rests a mat which actually receives the person's body. Proximate one end of the half round steel supports and spaced off the ground a short distance is a lower foot or leg rest, namely a padded cross bar, which also may be used by the person to help mount the back rest. At the other end of the half round steel supports, also spaced off the ground a short distance, is a rectangular opening formed in the mat which continues into a rectangular opening formed between the flat wood slats and between the two parallel half round steel supports, the opening provided for receiving the person's head, either face down or face up, allowing the person's head to be placed in such a position to permit one continuous alignment of the back through the neck, unimpeded by the person's head interrupting the continued arch of the back.

Situated centrally to the inventive back rest, and pointing near vertically upward are a pair of pull up supports which permit, by grasping the same, a person to pull themself up to a sitting position after being reclined, in order to get off the back rest. In addition, the pull up supports allow a person to support themself while in the process of lying back upon the back rest in order to do so in an easy, gentle manner.

Further, if desired, a pillow or head pad is available for insertion into the head opening of the mat and extends above the mat surface which provides a head rest for elevation of a person's head above the angle provided by the arch of the invention.

It is an object of the subject invention to provide a therapeutic back rest wherein the total body is elevated off the floor in order that no part of the body rests upon or contacts the floor such as to place an influence on the remainder portion of the body.

It is another object of the subject invention to provide a therapeutic back rest wherein the total back of a person is arched.

It is still another object of the subject invention to provide a therapeutic back rest wherein means are provided for holding the person's head such that the bones connecting the neck still continue in the same arc as does the back.

Other objects of the invention will in part be obvious and will in part appear hereinafter. The invention accordingly comprises the apparatus and method comprising construction, combination of elements, and arrangement of parts which are exemplified in the following detailed disclosure and the scope of the application which will be indicated in the claims.

BRIEF DESCRIPTION OF THE DRAWINGS

For further understanding of the nature and objects of the present invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
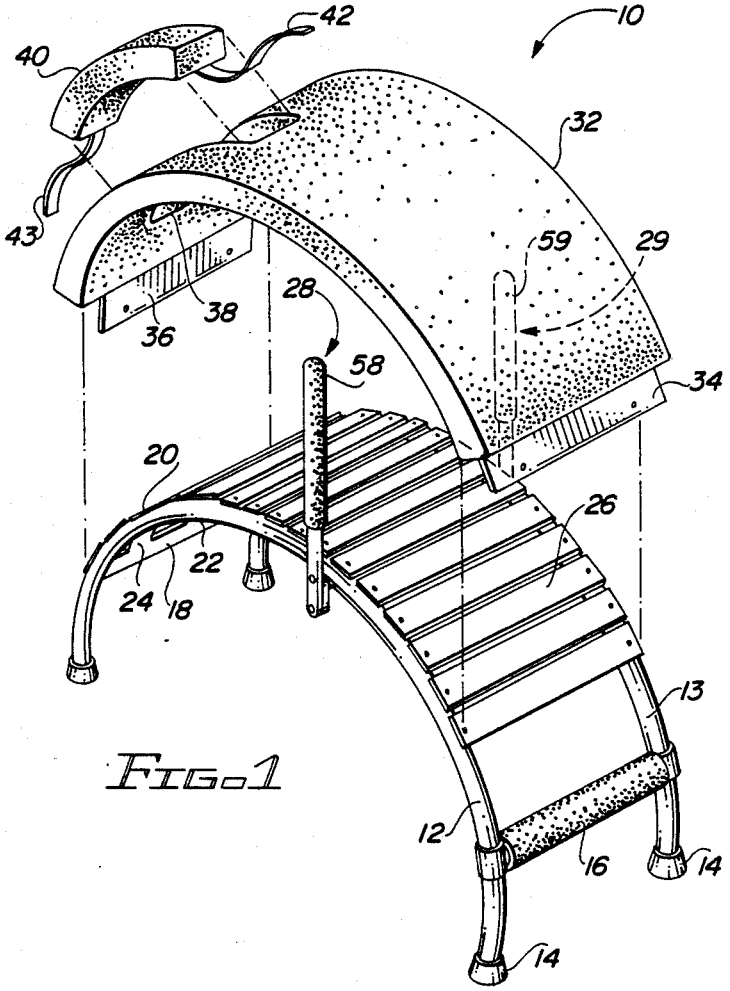
FIG. 1 is an exploded front perspective view of the subject therapeutic back rest.

Referring now to FIG. 1, a perspective exploded view of the subject therapeutic back rest 10 is shown. The supporting structure for the back rest comprises primarily two slightly more than half round or semi-circular steel or other metal supports 12 and 13 standing upright with their ends resting on the ground, the supports having at each end a rubber or plastic floor tip 14 adopted to provide a cushioning barrier between the end of the steel supports 12 and 13 and the floor, and also to render non skid qualities to the back rest. On the right hand side of back rest 10 is horizontal cross bar 16 which serves a tri-fold function, that of holding and supporting the half round steel supports 12 and 13, providing a rest for the person's lower feet area when using the invention, and serving as a first step for a person just mounting or getting on the device. Cross bar 16 is covered with a rubber or leather covering or padding as desired to present a soft surface for the person's feet.

At the opposite end or left hand side of back rest 10 is a pair of spaced apart horizontal cross bars, namely cross bars 18 and 20. These cross bars also serve one of the same purposes as cross bar 16, namely that of supporting and stabilizing the half round steel supports 12 and 13. However, centrally connecting cross bars 18 and 20 are a pair of spaced apart parallel structural members 22 and 24 which are also parallel to half round steel supports 12 and 13, and also having the same arc, structural members 22 and 23 forming between themselves the long sides of a rectangular opening. Cross bar 18 and 20 form the short sides of the opening.

All horizontal cross bars, i.e., 16, 18, and 20 are attached to the half round steel supports 12 and 13 by welding, or by utilizing thin metal plates which have formed in them, a pair of troughs at right angles to each other, the troughs adapted to encompass a portion of the cylindrical end of the cross bars while also riding over and encompassing a portion of the surface of the half round steel supports. Thereafter, through openings formed in these thin metal plates, as well as matching openings in the cross bar and the half round steel supports, are inserted bolts with attached nuts, which when tightened, provide structural integrity to the invention. In addition, by utilizing this latter method of construction, the therapeutic back rest may be knocked down for shipping or storage, and then re-assembled for use.

Attached to the top upper rounded surface of both half round supports 12 and 13 are a plurality of thin flat wood or metal slats or plates 26, plates 26 reaching from side to side and attached to the half round steel supports 12 and 13 by means of a single round headed bolt passing through a hole in the plates and steel supports. The bolt then receives a nut on the under side of the steel supports 12 and 13. These flat plates 26 extend throughout the majority portion o±the arc o±hal±round steel supports 12 and 13 on both sides from the apex; i.e., to upper cross bar 20 on one side and nearly down to lower padded cross bar 16 on the other side. It will be noted that in the area of the opening formed by the structual members 22 and 24, flat plates 26 only span the distance between one of these structural members and the nearest half round steel support such as to maintain the rectangular opening between structural members 22 and 24. In each of these cases, the flat plate is attached to the steel support and the structural members by the same use of round headed machine bolts and nuts.

Protruding upright from the half round steel supports 12 and 13 near the top of their arc are a pair of pull up supports 28 and 29. These supports extend up about 12 to 14 inches above the flat plates 26 and are attached to the half round steel supports by means of machine bolts passing through the pull up supports and a downward protruding tab which has been welded to half round supports 12 and 13. The pull up supports 28 and 29 are covered at their top end and about ¾ of their length with a rubber or leather covering 58 and 59 respectively. It is noted that the pull up supports 28 and 29 are not located at the very top of the half round steel supports 12 and 13 but rather off a short distance from the top.

Residing atop flat plates 26 is mat 32 which has a thickness of generally 2 inches or so. To each end of mat 32 is attached fabric flaps 34 and 36, each of these flaps adapted to wrap around the end flat plate on either end and be secured there by nails or screws to hold mat 32 in place. Mat 32 may be vinyl covered foam or cotton wadding, whatever may be desired.

At the end of mat 32 proximate the rectangular opening formed between parallel structural members 22 and 24 (and cross bars 18 and 20) is a second rectangular opening, namely head opening 38 adapted to conform to and align with the structurally formed opening. Lastly, an auxiliary head pad 40 is shown immediately above opening 38, head pad 40 being somewhat elongated while also triangular in cross-sectional shape and adapted to be fitted interiorly to opening 38 for those instances when the person does not wish to place his head in the opening, but in fact rest his head on the head pad elevated above the mat. Attaching to mat 40 are head pad straps 42 and 43 to additionally secure pad 40 in place (in addition to head pad 40 being wedged into opening 38).

In the preferred embodiment, with the orientation shown in FIG. 1, it is anticipated that the person will lie on therapeutic back rest 10 such that his feet in the area of the ankles rest on cross bar 16 and his head rests in the opening formed by structural members 22 and 24. By such means, pull up supports 28 and 29 are situated in the area between his waist and his knees. These are more fully shown in relationship with the person lying on the back rest in FIG. 5.

Figure 2:
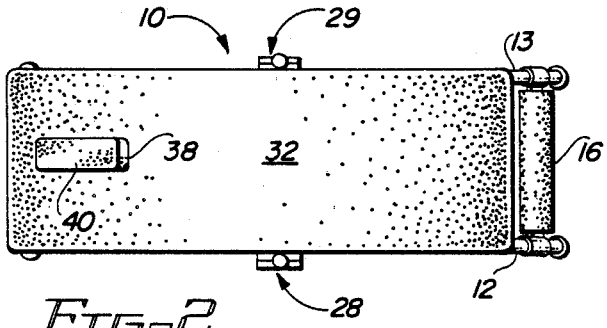
FIG. 2 is a top perspective view of the subject invention.

FIG. 2 is a top perspective view of the inventive therapeutic back rest 10 showing centrally mat 32, pull up supports 28 and 29 and the half round steel supports 12 and 13. Connecting half round steel supports 12 and 13 at one end is horizontal cross bar 16 with its covering material against which the patient rests his feet or mounts when starting use of the invention. At the left hand portion of FIG. 2 is shown head pad 40 in place encompassing opening 38 in the mat. In the perspective view shown in FIG. 2 it appears that the pad 32 is somewhat oval in shape - such is not the case. In the preferred embodiment, the pad 32 has the same width throughout its length as the steel supports 12 and 13 occupy parallel planes and are at all places the same distance apart and supports 12 and 13 underlie the edges of mat 32.

Figure 3:
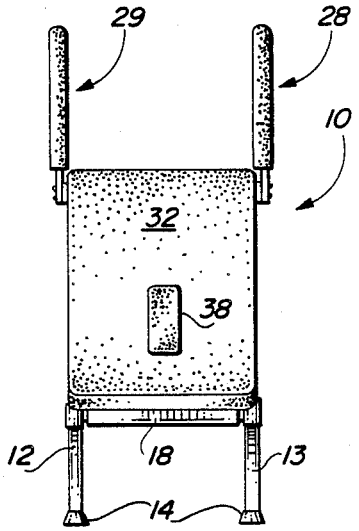
FIG. 3 is an end perspective view of the subject invention.

FIG. 3 is a perspective end view of the therapeutic back rest 10 seen from the front end, i.e., that end which would receive the person's head. Here the head pad has been removed revealing opening 38 in mat 32, which opening continues on through the opening formed between structural members 22 and 24, and lower cross bar 18 and cross bar 20 (all shown in FIG. 1). At the top of the figure are the pull up supports 28 and 29 covered with very soft material. At the lower portion of FIG. 3 are the lower ends of half round steel supports 12 and 13 with the rubber floor tips 14. Immediately above tips 14 is horizontal cross bar 18.

Figure 4:
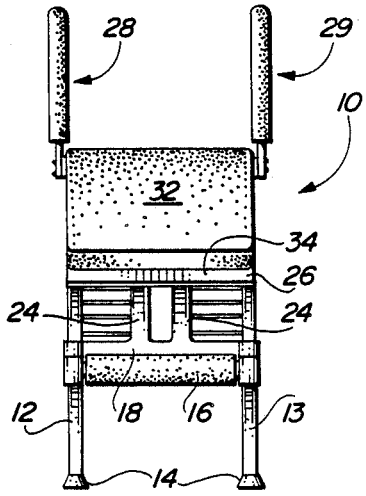
FIG. 4 is an end perspective view of the subject invention of the end opposite the end shown in FIG. 3.

Referring now to FIG. 4, a perspective end view of therapeutic back rest 10 is seen showing in the forefront that portion of the back rest which receives the person's feet. In the foreground are the half round steel supports 12 and 13 which supports the person together with the rubber floor tips 14. Immediately above the floor tips 14 and connecting the two half round steel supports is the lower horizontal cross bar 16 with its leather covering or its other soft material covering. Immediately above cross bar 16 is the first of the many slats or plates 26 with flap 34 attached to top mat 32 wrapped around the lengthwise edge of flat plate 26. Proceeding upward are the two pull up support bars 28 and 29 by which means the person pulls themself up or lowers themself down upon the mat. To the rear of the therapeutic back rest 10 shown in FIG. 4, one can see the last two flat plates 26 which cross from side to side between half round steel supports 12 and 13 and also the lower cross bar 18 and its connecting structural members 22 and 24 forming the rectangular opening.

Figure 5:
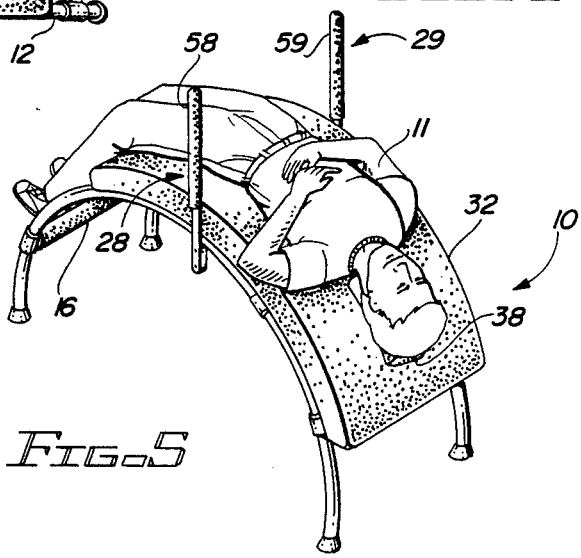
FIG. 5 is a perspective view of the subject therapeutic back rest being utilized by a person.

Lastly shown is a perspective view of the subject invention 10 with person 11 utilizing the therapeutic qualities of back rest 10. It is noted that the party is completely off the floor and neither his head nor his feet touch the floor. It has been found with the preferred embodiment of the invention, persons of heights from 5 feet through 6 feet 4 inches are easily accommodated. Shown in FIG. 5, party 11 has his head residing in the opening 38 formed in pad 32. Opening 38 is so sized as not to permit the head to fall through, but in fact is narrow enough to provide comfortable side holding of the patient's head in order that the spine which connects the head with the remainder of the body still maintains the same continuous curve of the semi-circular curve or arc of the device. The person's back then follows the same semi-circular curve of the device, modified slightly only by the distribution of the party's weight depressing each portion of pad 32. The party's feet preferably rest with their heels against padded cross bar 16. By elongation of head opening 38, various height individuals are accommodated wherein their heels may rest against the padded cross bar 16. It is noted that in addition to the arching of the patient's spine, the angle between the upper and lower portion of the legs is also a very comfortable angle. Mat 32 is sufficiently wide that a person's arms may, if desired, may be resting beside their torso, or, may be across the stomach as shown in FIG. 5 or, if desired, may even drape down toward the ground past the party's head. Further, the arch is so continuous that the person's pelvis also continues in the same arc at its joinder with the back.

It has been found that the subject therapeutic back rest is most satisfactorily when the radius of the arc forming the arch is in the range of 22 to 36 inches which assures that the arc forming the back rest is longer in length than a person's height, necessary to be sure the person is totally suspended above the ground. In the constructed embodiment, the radius of the arc was 24 inches, and the height of the arch at its highest point or apex was 30 inches above the floor.

When person 11 desires to remove themselves from the subject back rest, the party raises up sufficiently so that their arms may grasp the leather or rubber covering 58 and 59 on pull up supports 28 and 29 and thereby pull themself up completely to a sitting position atop back rest 10. Then, they may allow themself to slide downward until their feet engage the floor at which time they may push themself off back rest 10.

To enter back rest 10, preferably a patient will stand at the foot end of back rest 10 with the calves of the legs touching padded lower cross bar 16 and then allow their body to arch backward starting at the bottom of the rest until it comes to rest on pad 32. Reaching out, they may grasp the pull up supports 28 and 29 and pull themself up into position. Another method of mounting the back rest 10 is to stand on lower cross bar 16 and then sit upon pad 32, all the time holding on to the pull up supports 28 and 29. Then by moving themself upward to a position where their buttocks are at or near the center point of the arch, and while holding on to pull up supports 28 and 29, they then lower their back until it is resting upon pad 32.

In addition to being a therapeutic back rest, back rest 10 has been found to be very relaxing and places people in a very comfortable position. A few minutes a day upon the subject invention will re-invigorate a person, allowing them to continue with their work.

While only a preferred embodiment of the subject invention has been shown and described it will be understood that there is no intent to limit the invention by such disclosure, rather that it is intended to cover all modifications and alternate constructions falling with in the spirit and the scope of the invention as defined in the appended claims.

I claim:

1. A therapeutic back rest for placing a person's back, neck, and pelvis in a continuous curve when reclining comprising:

a pair of parallel, spaced apart semi-circular supports having first and second ends adapted to rest on the ground, said semi-circular supports having a radius sufficiently great than the arc defined by said supports is of such a length that a fully extended user may recline along said back rest with no part of the person touching the ground;

a foot cross bar connecting said semi-circular supports proximate said first end of said semi-circular supports;

a second cross bar connecting said semi-circular supports proximate said second end of said semi-circular supports;

a plurality of spaced apart slats operably attached to said semi-circular supports, said slats forming an arch adapted to receive the body of the reclining person and defining the arc that the person's back, neck, and pelvis is to conform to; and a third cross bar proximate said second cross bar, and a pair of spaced apart structural members, said second and third cross bars and said pair of structural members defining a rectangle, said rectangle adapted to receive and hold the person's head when the person is reclining on said back rest whereby the person's neck continues to conform to the curve of the person's back.

2. The therapeutic back rest as defined in claim 1 further including a mat, said mat adapted to lie upon said plurality of spaced apart slats, said mat adapted to receive a person's body when utilizing the back rest.

3. The therapeutic back rest as defined in claim 2 wherein said mat includes a rectangular opening therethrough, said rectangular opening adapted to conform to and overly said structural rectangular opening whereby a person's head, when lying on the mat, is received in the rectangular opening in said mat and said structural opening and the person's neck continues to conform to the curve of the person's back.

4. The therapeutic back rest as defined in claim 3 wherein said semi-circular supports have an apex and further including a pair of pull up supports attached to said semi-circular supports, said pull up supports consisting of elongated rods with a padded covering, said pull up supports situated proximate said apex of the arch formed by the semi circular supports whereby a person, when reclining upon said back rest may utilize said pull up supports to lower and to raise themself upon the said back rest.

5. The therapeutic back rest as defined in claim 4 wherein said radius of said semi-circular supports is in the range of 22 to 36 inches.

6. The therapeutic back rest as defined in claim 5 further including a removable head pad to receive a person's head, said head pad adapted to be secured in said rectangular opening of said mat and said structural opening in said back rest, said head pad extending above said mat whereby a person's head may be elevated above the continuous curve of said back rest by utilizing said head pad.

7. The therapeutic back rest as defined in claim 6 wherein said foot cross bar includes a padded covering whereby a person, when reclining upon said back rest, may rest their feet on said padded foot cross bar.

8. The therapeutic back rest as defined in claim 7 wherein said semi-circular supports include a plurality of foot cushions, said foot cushions adapted to cover said ends of said semi-circular supports to contact the ground whereby non-skid qualities to said back rest may be imparted.

9. The therapeutic back rest as defined in claim 8 wherein said mat has two ends, and further including a pair of flaps, one flap attached to each end of said mat, said each of said flaps adapted to be attached to one of the plurality of slats whereby said mat may be secured to said slats of said back rest.

10. The therapeutic back rest as defined in claim 9 wherein said semi-circular supports comprise steel and said slats comprise wood.

* * * * *